US009693623B2

(12) United States Patent
Bryant

(10) Patent No.: US 9,693,623 B2
(45) Date of Patent: Jul. 4, 2017

(54) ADJUSTABLE HOLSTER FOR PORTABLE DEVICES

(71) Applicant: Charles E. Bryant, Blue Springs, MO (US)

(72) Inventor: Charles E. Bryant, Blue Springs, MO (US)

( * ) Notice: Subject to any disclaimer, the term of this patent is extended or adjusted under 35 U.S.C. 154(b) by 0 days.

(21) Appl. No.: 15/393,661

(22) Filed: Dec. 29, 2016

(65) Prior Publication Data

US 2017/0105511 A1 Apr. 20, 2017

Related U.S. Application Data

(63) Continuation-in-part of application No. 15/066,981, filed on Mar. 10, 2016.

(51) Int. Cl.
*A45F 5/02* (2006.01)
*A45C 11/00* (2006.01)
*B25H 3/00* (2006.01)

(52) U.S. Cl.
CPC ..... *A45F 5/021* (2013.01); *A45C 11/00* (2013.01); *B25H 3/00* (2013.01); *A45C 2011/002* (2013.01); *A45C 2011/003* (2013.01); *A45F 2200/0516* (2013.01); *Y10S 224/93* (2013.01)

(58) Field of Classification Search
CPC ..... A45F 5/021; A45F 2200/0508; A45F 2200/0516; A45F 2200/0525; Y10S 224/904; Y10S 224/929–224/93; A45C 2011/001–2011/003
USPC ..... 224/240, 904, 929–930; D3/218; D14/250
See application file for complete search history.

(56) References Cited

U.S. PATENT DOCUMENTS

D203,101 S * 12/1965 Holder ..... 206/493
4,234,116 A * 11/1980 Myers ..... A45F 5/00 224/250
4,420,104 A * 12/1983 DiIenno ..... A45F 5/021 224/250
4,951,910 A * 8/1990 March ..... B60N 3/103 224/482
4,984,760 A * 1/1991 Cohn ..... F16M 13/022 248/126
5,461,814 A * 10/1995 Reid ..... A01N 25/18 36/136
5,941,434 A * 8/1999 Green ..... A45F 5/02 224/195
6,237,822 B1 * 5/2001 Vidal ..... A45F 5/14 224/234

(Continued)

*Primary Examiner* — Scott McNurlen
(74) *Attorney, Agent, or Firm* — Kenneth W. Iles

(57) ABSTRACT

The holster includes a solid basically flat rectilinear shape. In one embodiment, a horizontal slot through the thickness of the base receives a strap that is wrapped around the portable device, while a second strap, vertically oriented, is fixed in a keyway in the bottom of the base and threaded through a vertical slot in the thickness of the base and is brought upward over the horizontal strap. In a second embodiment a pair of horizontal straps are set in keyways and are wrapped around a portion of the portable device, holding it in place. All straps having a webbing having one side covered by the hook portion of a hook and loop fastening system and the other side covered by the loop elements of a hook and loop fastening system, allowing opposite sides, or faces, of any single strap to be fastened to itself.

17 Claims, 10 Drawing Sheets

(56) References Cited

U.S. PATENT DOCUMENTS

| | | | | |
|---|---|---|---|---|
| 8,573,458 | B1 * | 11/2013 | Hamilton | A45F 5/021<br>224/250 |
| D739,138 | S | 9/2015 | Hamilton | |
| D744,747 | S | 12/2015 | Hamilton | |
| 2001/0029170 | A1 * | 10/2001 | Fujihashi | H04M 1/05<br>455/575.1 |
| 2009/0206098 | A1 * | 8/2009 | Garahan | A45F 5/02<br>220/737 |
| 2011/0049005 | A1 * | 3/2011 | Wilson | A45C 11/00<br>206/701 |
| 2011/0247959 | A1 * | 10/2011 | Nelson | A45F 5/00<br>206/525 |
| 2011/0281084 | A1 * | 11/2011 | Ashwell | C09J 7/02<br>428/195.1 |

* cited by examiner

ADJUSTABLE HOLSTER FOR PORTABLE DEVICES

CROSS-REFERENCE TO RELATED APPLICATIONS

This application is continuation-in-part of U.S. application Ser. No. 15/066,981, filed Mar. 10, 2016, currently pending.

STATEMENT REGARDING FEDERALLY SPONSORED RESEARCH OR DEVELOPMENT

Not applicable.

SEQUENCE LISTING

Not applicable.

BACKGROUND OF THE INVENTION

The present invention is related to an adjustable holster for tools, small appliances, or the like. The adjustable holster is particular adapted for holding personal electronic devices, such as cell phones of any size, computer tablets, tools, and the like.

DESCRIPTION OF THE RELATED ART INCLUDING INFORMATION DISCLOSED UNDER 37 C.F.R. 1.97 and 1.98

Personal electronic devices such as cell phones are made in a great variety of sizes. Finding a safe and quickly accessible place to store them on the user can be a challenge. Many people put them into a pocket, often a rear seat pocket, sometimes a front pants pocket, sometimes a shirt pocket. This practice limits the number of other articles that can be placed into the pocket with the phone, as well as the nature of the other articles, since they may scratch or break the phone's screen. Users will sit down, sometimes cracking or breaking the screen when the device is placed in a pants pocket. When the phone is stored in a shirt pocket, it will often fall out when the user bends over, sometimes cracking or breaking the screen. This problem is so pervasive that many companies sell expensive insurance for these accidents. Another problem is that the user may inadvertently dial and call a phone number from just moving around if the device is stored in a shirt pocket, annoying the recipient of the inadvertent call, increasing the user's phone bill, and perhaps inadvertently communicating confidential information to another.

A holster or case that is attached to a belt or pants waistband is an attractive alternative for many users. A great number of holsters are available for storing a device safely while keeping it readily available to the user. Unfortunately, most, if not all of these holsters are made in a fixed configuration and size and can be used only with one size of device. A device that is too large for the fixed size holster simply will not fit, while a device that is too small for the fixed size holster will not be held securely in it and may fall out it.

Some of these holsters have been patented. For example, Hamilton is the inventor of U.S. D744,747 S, U.S. D739,138 S, both for a Portable Article Carrier and U.S. Pat. No. 8,573,458 B21 for an Attachable Carrier for Portable Articles, which are similar and disclose a holster for cell phones or the like. The holster is formed from straps or belts, with one strap horizontally oriented to embrace the stored device at about the mid-point of the height of the device and a vertically oriented strap that loops from the back of the stored device to the front of the stored device and that fastens to the horizontal strap by sewing or the like. Another strap comes down over the top of the stored device and may be closed against the front vertical strap to prevent the stored device from falling out or being accidentally removed from the holster and can be fastened by hook and loop fasteners or the like. A belt loop allows the user to suspend the holster from belt. A disadvantage of this structure is that a belt or the like must be worn by the user if the holster is to be kept waist-high and then the user must remove at least a portion of the belt from the belt loops of his pants in order to install or remove the holster from the user's belt, that is, the holster cannot be attached to a waistband, from which is easily removed by the user if desired. The horizontal and vertical straps that form the body of this holster are permanently fixed to one another, "by sewing, adhesive-bonding, or heat bonding." All of these methods add extra steps and cost to the manufacturing process. There is, moreover, no disclosure or suggestion that this holster can be adjusted in any fashion to accommodate different sized devices, requiring the seller to provide different sized devices an requires users to choose the appropriate size holster. This holster does not have any rigid base or backing, making the edges of the stored device vulnerable to damage from doorways or the like.

Therefore, there is a need for an adjustable holster for portable devices that is adjustable to accept devices of substantially different sizes; that helps reduce the exposure of the stored device to damage caused when the user bumps into obstacles; that can be securely and easily attached to a belt, waistband or the like without a belt loop on the holster.

BRIEF SUMMARY OF THE INVENTION

Accordingly, it is a primary object of the present invention to provide an adjustable holster for portable devices that can be adjusted by the user to accommodate devices of substantially different sizes.

It is another object of the present invention to provide an adjustable holster for portable devices that helps reduce the exposure of the stored device to damage caused when the user bumps into obstacles.

It is another object of the present invention to provide an adjustable holster for portable devices that can be securely and easily attached to a belt, waistband or the like without a belt loop on the holster.

These objects are achieved by providing a solid basically flat rectilinear shape. In one embodiment, a horizontal slot through the thickness of the base receives a strap that is wrapped around the portable device, while a second strap, vertically oriented, is fixed in a keyway in the bottom of the base and threaded through a vertical slot in the thickness of the base and is brought upward over the horizontal strap. In a second embodiment, a pair of horizontal straps are set in keyways and are wrapped around a portion of the portable device, holding it in place. All straps having a webbing having one side, or surface, covered by the hook portion or elements of a hook and loop fastening system and the other, or opposing, side or surface, covered by the loop elements of a hook and loop fastening system, allowing opposite sides, or faces, of any single strap to be fastened to itself. The horizontal adjustment strap is fastened to itself at a point chosen by the user along the front of the holster or at a side, resulting in two interlocked layers of the horizontal strap along the front of the holster with one layer on top of the other and with the two layers aligned with one another. The vertical adjustment strap has an upper portion that is fastened between the two layers of the horizontal strap along the front of the holster, resulting in an interlocked sandwiched bond in which the vertical strap is fastened to the horizontal strap throughout the entire surface area of both sides of the vertical adjustment strap wherever the vertical adjustment strap contacts the two layers of the horizontal adjustment strap 20. Alternatively, webbing straps without hook and loop fastener system may be used, with conventional buckles used to secure each strap at the desired length.

In another embodiment, the straps or web members are covered with smooth tape, which is adhesive tape, which is seated in recessed channels along the two edges of the base and the bottom of the base. These recessed channels provide alignment fixtures as well as smooth, positive adhesion points for the ends of the tape that transitions from the base to the horizontal and vertical adjustment straps, which are covered by the tape. Also, because these channels are recessed, the tape ends are securely adhered to the base, but below the rear outer surface of the base, which protects the tape ends from peeling back and becoming detached during daily rigorous use, since the ends of the tape are not exposed to rubbing against anything during normal use. Furthermore, after the tape is properly installed, the tape prevents any end point edges of the webbed straps from peeling back and becoming detached, preserving the interlocked adjusted dimensions of the assembled holster. In any case, the holster according to the present invention is thin, lightweight and pleasing in appearance, but is very strong.

In another improvement, a friction pad holder is seated in a mating well in the rear of the base and a friction pad is seated in a mating well in the friction pad holder. This allows the amount of friction between the belt or the like to be adjusted by providing friction pads of different thicknesses. This friction system substantially eliminates the problem of friction surfaces, such as tape or the like, from peeling away from the base, as the holster is repeatedly attached and detached from a belt or the like.

These and other objects and advantages of the present invention will become apparent from the following description taken in connection with the accompanying drawings, wherein is set forth by way of illustration and example, the preferred embodiments of the present invention and the best mode currently known to the inventor for carrying out his invention.

DETAILED DESCRIPTION OF THE INVENTION

Figure 1:
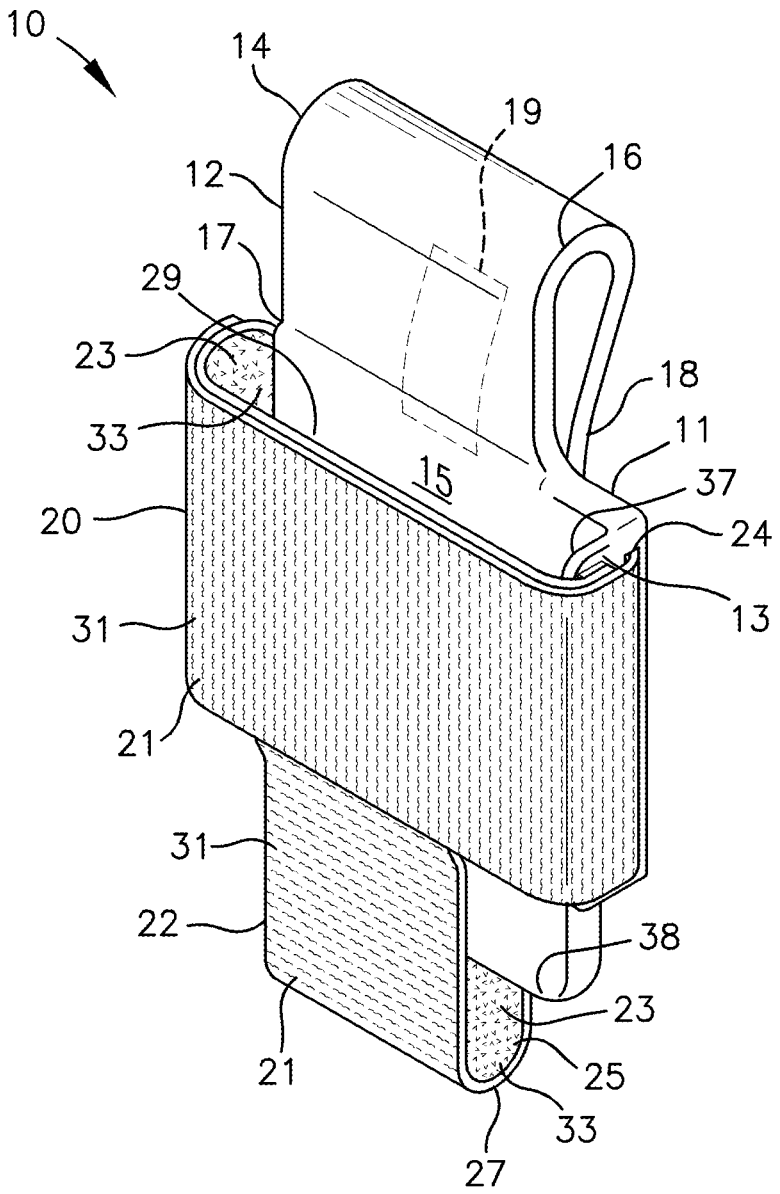
FIG. 1 is an isometric view of an adjustable holster for portable devices (holster) according to the present invention shown assembled and empty.

Referring to FIG. 1, a front isometric view of an adjustable holster for portable devices having interlocking horizontal and vertical adjustment straps (holster) 10 shown assembled for use, including base 12 made of rigid plastic or the like having front surface or face 15, a rear face or surface 36, and a perimeter having a bottom edge 38, a top edge 11, a right side or edge 13 and a left side or edge 17 and has a generally rectilinear shape. At the top or top edge 11 of the rigid base 12 is a hook fastener portion or elements, 14, which includes a sharply curved spring portion 16 at its top and a depending flange portion 18 for fastening the holster to a belt, waistband or the like by simply aligning the hook fastener portion 14 with the waistband or the like and pushing down until the lower surface of the curved spring portion 16 contacts the waistband or the like. The hook fastener portion 18 has spring action tending to retain the flange portion 18 close to the rear face 36 of the base 12, providing firm connection to a belt, waistband or the like. A gripping pad 19 is fixed to the inside surface of the hook fastener portion 14 in such a position that it contacts the belt, waistband or the like that is fastened to. The gripping pad 19 makes placing the holster onto a belt or waistband or removing it harder and therefore provides a more secure connection. The gripping pad 19 may be the hook or loop portion of a hook and loop fastener strip or any material that increases friction without being too abrasive. The gripping pad 19 may be glued onto the hook fastener portion 14 of the base 12 or may have be a peel and press type adhesive already applied to the rear surface of the gripping pad 19. The hook fastener portion 14 may be replaced by a loop if desired, providing a more secure but more awkward connection to a belt, if desired. A closed loop, a hook with a closure element or the like may also be used either in conjunction with, or a replacement for, the hook fastener portion 14.

Figure 6:
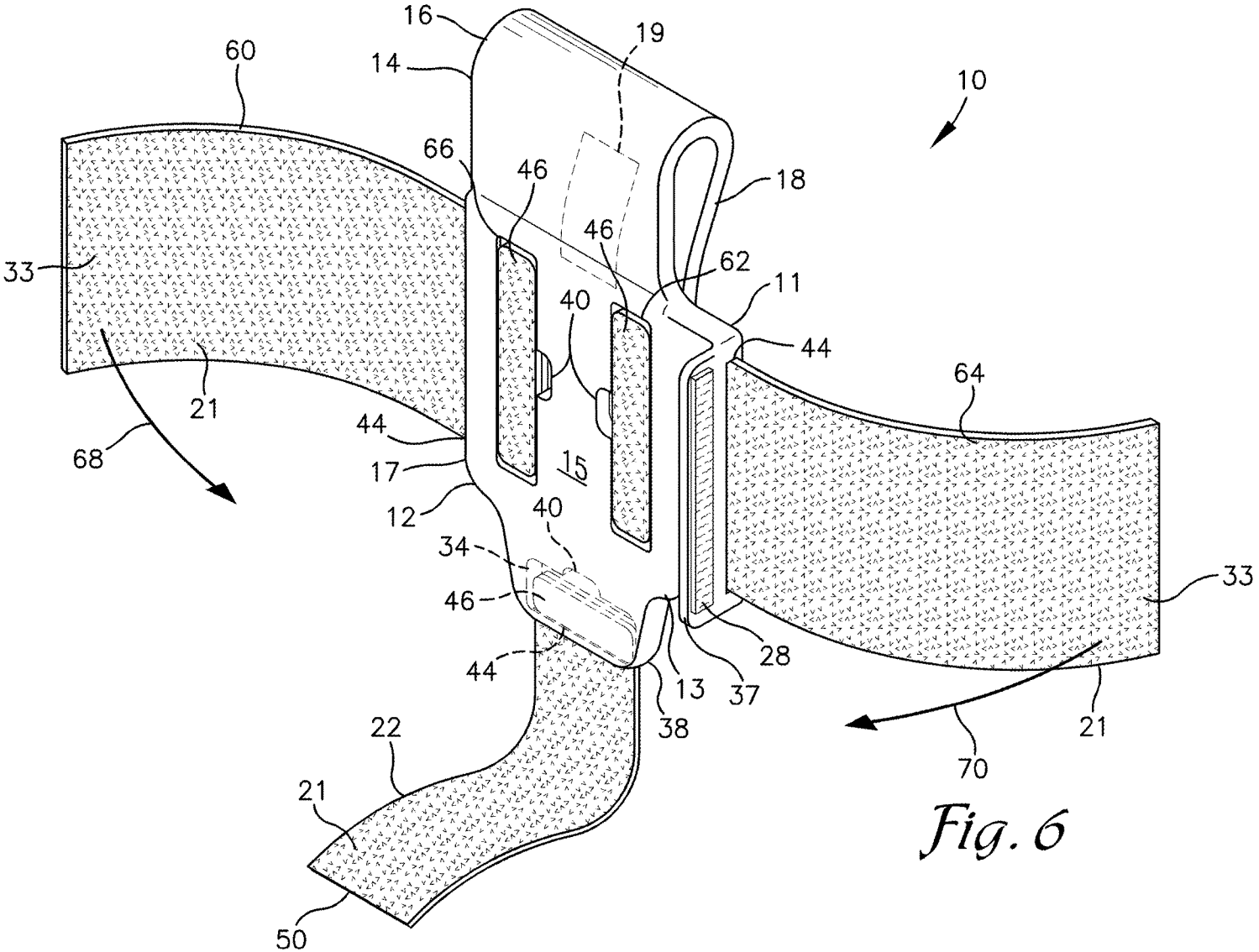
FIG. 6 is a front isometric view of an alternative embodiment of the holster of FIG. 1 in which three separate straps are used.
Figure 7:
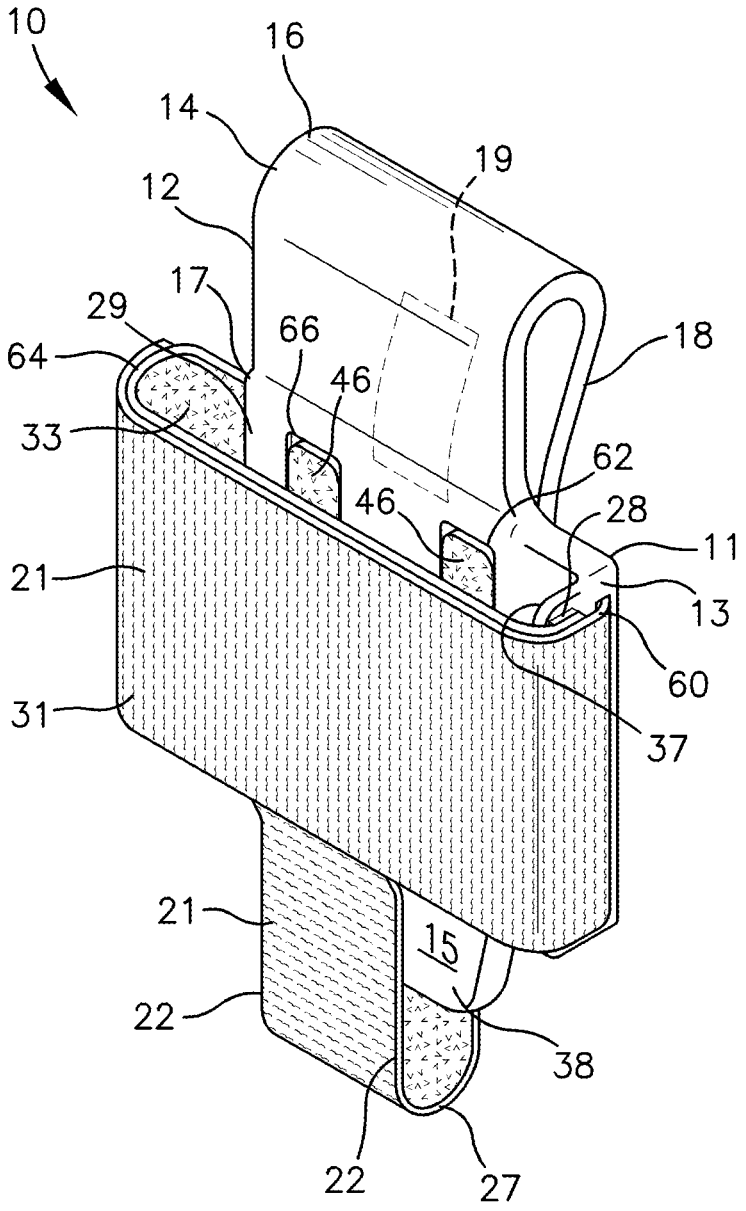
FIG. 7 is an isometric view of the holster of FIG. 6 shown fully assembled and ready for use.

The portable device 54 (first appearing in FIG. 3) is held in place against the base 12 by two straps, a horizontally disposed strap 20 and a vertically disposed strap 22. Although the portable device may be any type of device or tool that will conveniently fit into the holster 10, it is contemplated that the portable device 54 will typically be an electronic communications device such as a cell phone, computer tablet, or the like that will have a screen for providing a visual output. The term portable device 54 refers to any tool or device that may be carried in the holster 10. Both straps are made from a flexible webbing material having low profile and small hook fastener elements covering the entire surface of one side of the strap material and having low profile and small loop fastener elements covering the entire surface of the other side of the strap material. These fastener elements are densely packed. As shown in FIG. 1, on both the horizontally oriented strap 20 and the vertically oriented strap 22, the outer surface 31 is covered with hook elements 21 and the inner surface 33 is covered with loop elements 23 of the hook and loop fastener system. The face of each strap 20, 22 that is exposed to view could be either the hook covered side or the loop covered side of the straps 20, 22, but the hook-covered side 31 is preferred because the hook covered side 31 appears smoother than the loop covered side 33, which looks fuzzy and rough. (The same numbering and convention apply to the two horizontal straps 60, 64, discussed in connection to FIGS. 6, 7, below.) Naturally, either the hook covered side or the loop covered side could be either the front or expose side or the rear or largely hidden side of the straps. The important feature is that all of one side be covered with hook elements and all of the other side be covered with loop elements. Such straps or webbing are commercially available. Alternatively, straps having only portions of the straps needed for fastening a portable device 54 into the holster 10 and for necessary fastening of the various straps to one another with the remainder of the straps being the underlying webbing, could be developed. Having one side of the straps 20, 22 covered with the hook portion and the other side covered with the loop portion of hook and loop fastener system results in a strap that can be fastened to itself at any point along its length, or to the corresponding element side of another like strap at any point along either of the two straps. This characteristic of the webbing or strap material gives the holster 10 its adjustability for a specific sized device because it does not matter how long the straps are initially since the user can cut them to the proper length with ordinary scissors. The straps 20, 22 are provided to the user in lengths that are longer than will be needed for any portable device 54 that a particular sized base 12 might accommodate. The user simply installs the straps 20, 22 as shown below and cuts them to a suitable length. The straps should be tight enough to hold the portable device 54 firmly, while still allowing the user to remove the portable device 54 from the holster 10 easily and to put the portable device 54 back into the holster 10 easily. No adjustment or fastening is needed for these steps because the straps 20, 22 (e.g., FIG. 1) or the straps 60, 64, 22 (FIGS. 6-7). The holster 10 is easily serviced because any of the straps can easily be replaced, either individually or all together.

Additional straps or replacement straps may be provided so that the user can use the holster 10 for a larger portable device 54 if one is acquired and the straps cut to hold a smaller portable device 54 are too short for the larger portable device 54 or if the straps show signs of wear or the user wants to install straps of a different color. The design of the holster 10 allows a very small number of different sized bases 12 to securely accommodate practically any sized portable electronic device from very small cell phones to computer tablets. The strap 20 is threaded through a horizontally oriented slot 24 through the base 12, which is more clearly shown in FIG. 2.

Figure 4:
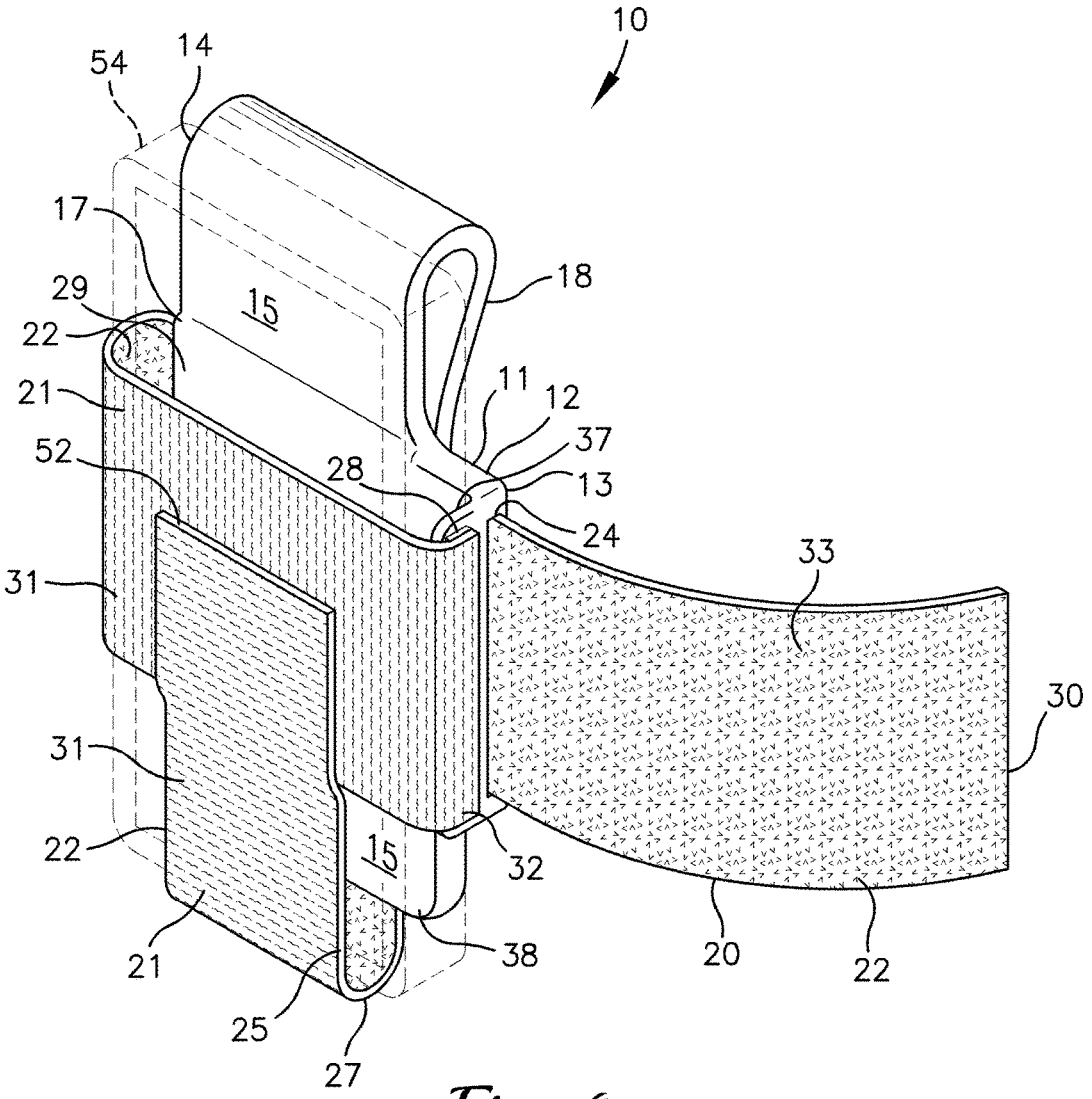
FIG. 4 is a rear isometric view the holster of FIG. 1 showing an intermediate step in the adjustable fitting of the holster to specific portable device.

The straps 20, 22 may be of any desirable width, but generally and as shown, the horizontally oriented strap 20 is wider than the vertically oriented strap 22 since the horizontally oriented strap 20 provides lateral stability to the portable device 54 and protection from the user bumping into things. The horizontally disposed slot, or slot 24, is formed through the thickness of the base 12, that is, it defines a passageway through the base 12 with an opening to it on both the right side edge 13 and the left side edge 17. The vertically oriented strap 22 is pulled up from the bottom of the base 12, to which it is fixed, and over first-applied layer of the horizontal strap 12 on the front face 15 of the portable device 54 as shown in FIG. 4, forming a loop 25 having a lowest point, which defines the bottom 27 of the holster 10, with the portable device 54 being seated in the well 29 formed by the closed loop of the horizontally oriented strap 20 and the vertically oriented strap 22.

A narrow strip of a hook or loop fastener material (narrow strip) 28 is fixed to an edge 30 of the base 12 adjacent to and parallel to an opening forming the slot 24, which passes through the entire width of the base 12. The narrow strip of a hook or loop fastener material 28 can be fastened to the base by any permanent adhesive or a peel and stick type material. The outer surface of the narrow strip 28 is either the hook portion or loop portion of a hook and loop fastener system with the surface pressed against the base 12 being flat. Either end of the strap 20 can be inserted into the slot 24 and threaded through it and either end of the strap 20 can be fastened to the narrow strip 28. As shown, the right end 30 of the strap 20 is secured to the narrow strip 28 (with right and left considered by viewing the holster from the front, i.e., the front face 15 of the base 12). The corresponding hook and loop fastener side of the strap 20 must be presented to the narrow strip 28. That is, if the narrow strip 28 is covered with the hook portion of a hook and loop fastener, the face of the strap 20 that is connected to the narrow strip 28 must be the side that is covered by the loop portion and vice versa. The fastening between the strap 20 and the narrow strip 28 allows the strap 20 to be pulled firmly against the portable device 54 and then the left end 32 of the strap 20 is threaded through the slot 24 and is then wrapped around the front face of the portable device 54, resulting in two layers of the strap 20 on the front face of the portable device 54, with the vertically oriented strap 22 sandwiched between the two layers of the horizontally disposed strap 20 such that both sides of the vertically disposed strap 22 lock with mating fastener elements on the horizontally disposed strap 20. This structure assures that the strap 20 will fasten to itself because when the two layers of the strap 20 cross along the front of the portable device 54, the mating surfaces will always present a hook covered portion and a loop covered portion to each other. This is the case because when the strap 20 is passed through the slot 24 and wrapped around the portable device 54, the opposite faces or sides of the strap 20 will always meet across the portable device 54 and therefore, they will always fasten to one another. This is the case regardless of which end of the strap 20 is the starting end and regardless of which face, that is, the hook covered side or the loop covered side, is facing the front of the holster 10 as it first crosses the portable device 54. Alternatively, the narrow strop 28 can be omitted and the user can simply hold the end of the strap 20 that is close to the front face of the portable device 54 that the holster 10 is being adjusted to fit.

A flange 37 is formed along the right side 13 of the base 12 and is perpendicular to the front face or surface 15 of the base 12 and projects forward of the front face 15. The strip 28 is fastened to the side of the flange 37. The flange 37 runs the entire length of the height of the slot 24, and somewhat farther above and below the slot 24. The length of the projection of the flange 37 is a matter of deign choice but is generally somewhat less than the thickness of a typical portable device 54 and typically lies in a range of about 4 mm-8 mm (3/16"-3/8"). The flange 37 serves as a locator for positioning the portable device 54 onto the base 12 and as a stop that prevents the portable device from slipping off the side of the base 12 during installation. In the embodiment of FIG. 1, the flange 37 allows the user to hold the portable device firmly against the flange 37 while cinching the horizontally disposed strap 20 firmly against the portable device 54. In the embodiment of FIGS. 6-7 (below), the flange 37 serves the same purposes and to utilize the stop function of the flange 37 best, the left horizontally disposed strap is fastened first, as shown in FIG. 7. The flange 37 could be formed on either the left or the right side of the base 12 in any embodiment. The flange 37 could be omitted if desired, but its advantages in customizing the holster 10 for a particular size of portable device 54 would be lost.

Figure 2:
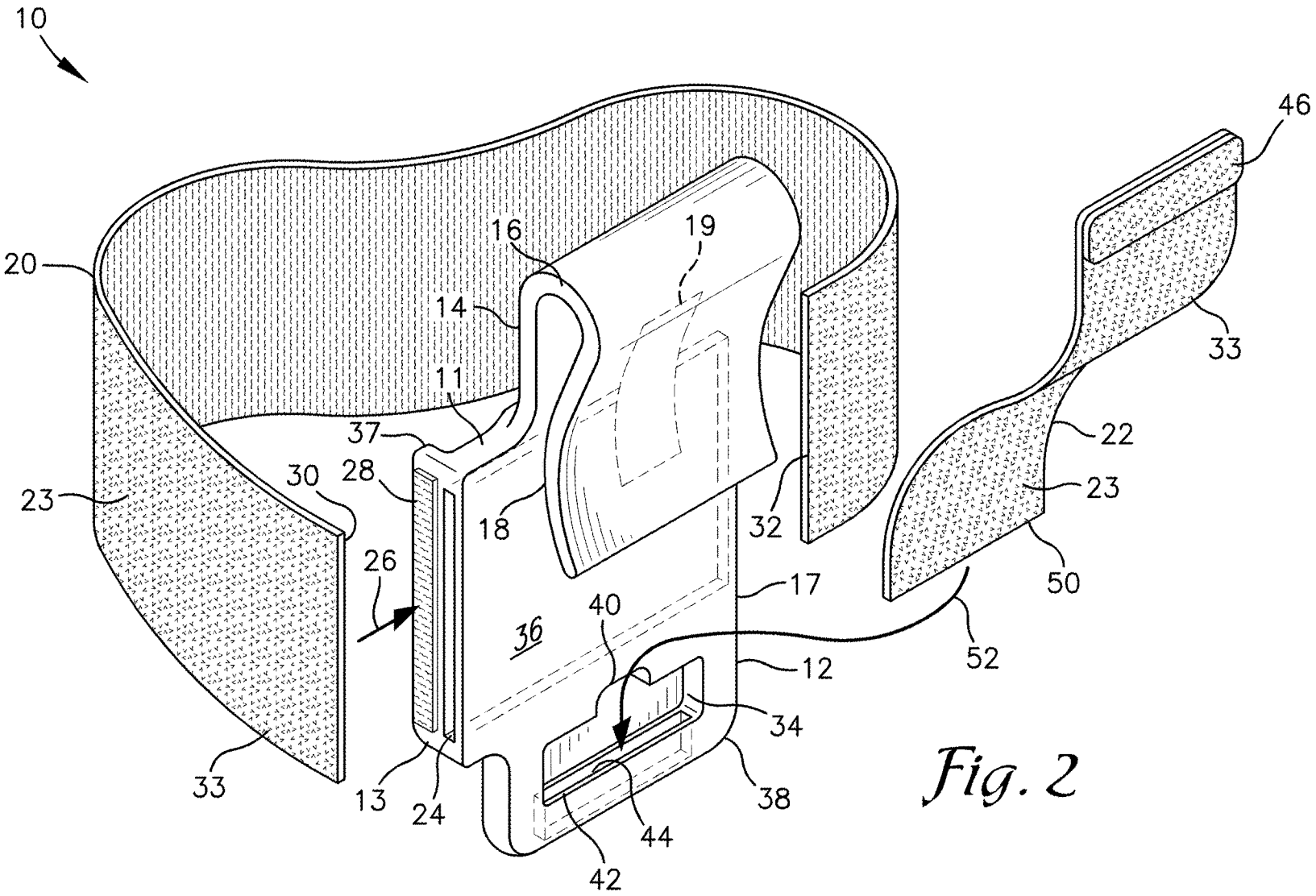
FIG. 2 is an isometric view of the holster of FIG. 1 shown disassembled.

Still referring to FIG. 2, a bottom strap is needed to form a bottom of the holster 10. This function is provided by the strap 22. The strap 22 is shorter than the strap 20 and forms a bottom to the holster 10 and is wrapped upward around the bottom edge 38, passing upward over a portion of the front face 15 and overlaps the inner portion of the horizontal strap 20, locking the vertical strap 22 in place. A keyway 34 is formed into the rear surface 36 of the base 12 adjacent to the bottom edge 38 of the base 12. The keyway 34 is recessed into the base 12 basically rectangular in shape with the width of the keyway 34 being slightly wider than the width of the strap 22. An arched portion 40 at the top of the keyway 34 provides easy access to the keyway 34 with the strap 22 installed in it, allowing the user to remove the strap 22 readily if desired. Along the bottom edge 42 of the keyway 34 is a keyway slot 44, or vertically oriented keyway slot 44, which is vertically oriented in this placement. The keyway slot 44 and all keyway slots discussed here define a passageway through the thickness of the base 12. The top end 46 of the strap 22 includes a stop member 46, which is small strip of material that is permanently fastened to the top end 46 of the strap 22. The thickness of the strap 22 and the stop member 46 together is the same as depth of the keyway 34, so that the stop member is flush with the rear surface 36 of the body 12 when the strap 22 is installed. The bottom end 50 of the strap 22 is threaded through the slot 44 as indicated by the arrow 52 and pulled downwardly until the stop member 46 is fully seated in the keyway 34. Then the strap 22 is pulled upwardly over the face of the portable device 54 and is sandwiched between the two layers of the strap 20. The faces of the straps 20, 22 are oriented such that when the strap 22 is sandwiched between the layers of the strap 20, both sides of the vertically oriented strap 22 are gripped by corresponding hook and loop fastener portions.

Figure 3:
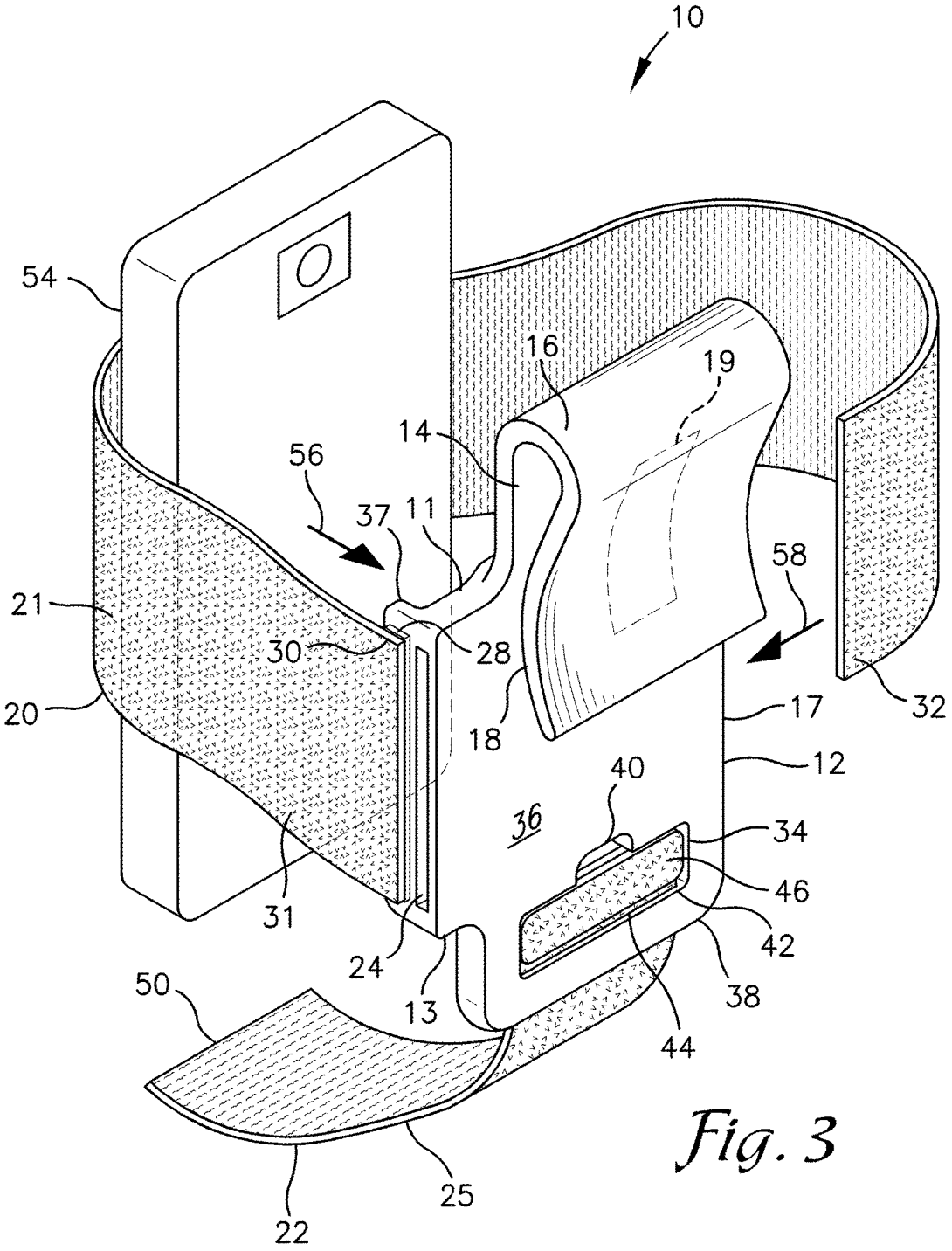
FIG. 3 is an isometric view of the holster of FIG. 1 shown assembled and ready to accept a portable device for adjusted fitting.
Figure 5:
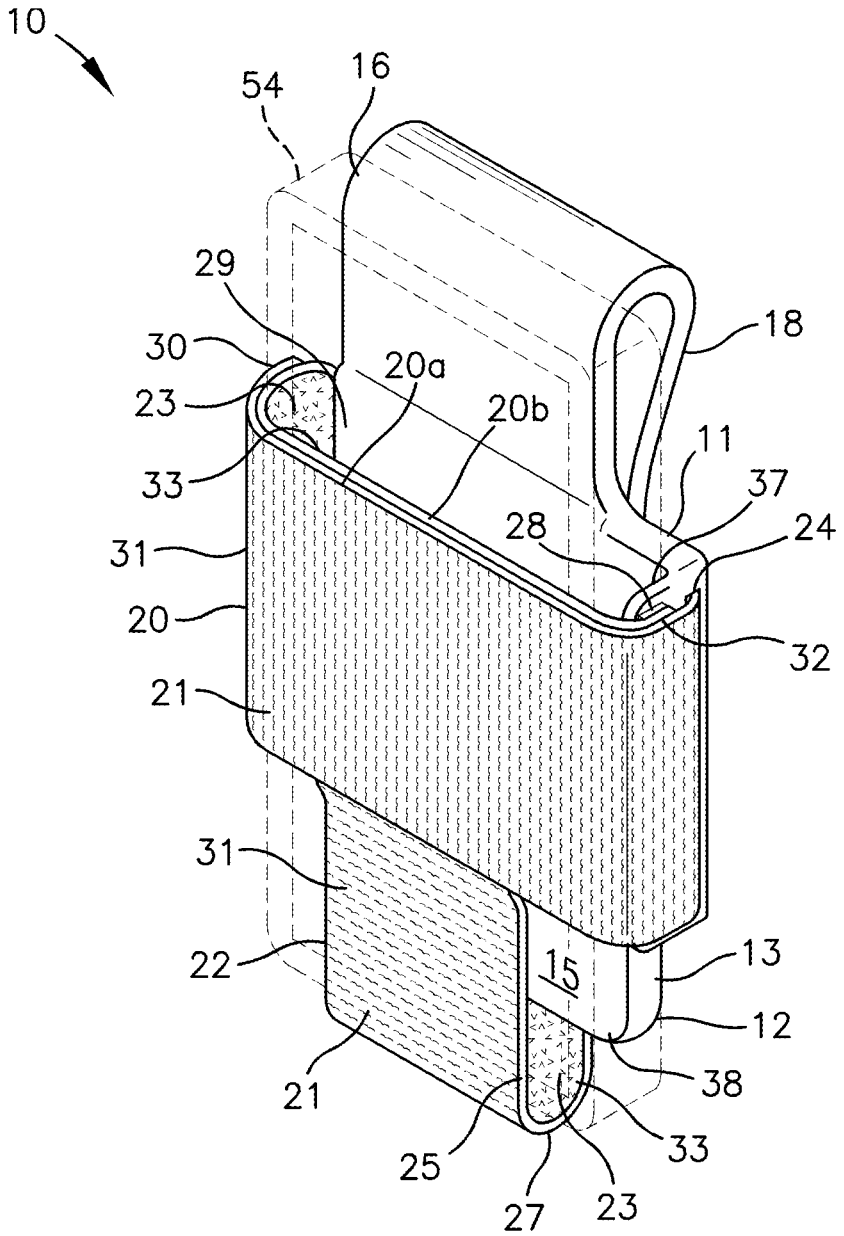
FIG. 5 is a front right isometric view of the holster of FIG. 1 shown completely assembled and holding portable device.

Referring to FIGS. 3, 4, 5, the portable device 54, in this case a cell phone, is placed against the front surface 15 of the base 12 as shown by the arrow 56. The right end 24 of the horizontally oriented strap 20 has been attached to the narrow strip 28 and the left end 30 of the strap 20 is being pulled around the portable device 54 and inserted into the slot 24 as indicated by the arrow 58 and then pulled until the portable device 54 is firmly seated against the base 12. Next, the lower end 50 of the vertically oriented strap 22 is pulled up and secured to the horizontally disposed strap 20 along the centerline of the portable device 54 and any excess length is cut off. Next, the horizontally disposed strap 20 is pulled over the portable device 54 and secured to the vertically oriented strap 22 and to itself and any excess length is cut off. The holster 10 is now ready for use, as shown in the completed configuration shown in FIG. 5. The attachment of the vertically oriented strap 20 to the holster 10 base 12 is very strong because the vertically oriented strap 22 is fastened to both layers of the horizontally disposed strap 20 throughout the entire surface area of both sides of the contact surface area between the vertically oriented strap 22 and the horizontally disposed strap 20, creating an interlocked or interlocking system for securing the vertically oriented strap 22 to the two layers of the horizontally disposed strap 20, with the upper end of the vertically oriented strap 22 being sandwiched between the outer layer 20*a* of the horizontally disposed strap 20 and the inner layer 20*b* of the horizontally disposed strap. (as shown in FIG. 5). The two layers 20*a*, 20*b* of the horizontally disposed strap are entirely laid one over the other, creating a strong interlocking fastening system along the entire surface area where they contact each other. The interlocking of the vertically oriented strap 22 with the layers 20*a* and 20*b* of the horizontal strap 20 also providing the adjustability of the vertically oriented strap 22 since the upper end of the vertically oriented strap 22 is indeterminate, with its final length being determine by the user in accordance with the length of his portable device 54 and how high above the top edge of the horizontal strap 20 the user wants it to extend. The use of a double layer of the horizontal strap 20 also provides the adjustability of the horizontal strap 20, since the user cuts any excess from the length of the horizontal strap 20 after using his portable device 54 to determine the appropriate size of the pocket of the holster 10 and then doubles the horizontal strap 20 over itself, creating the layers 20, 20*b*, which fasten to themselves. That is, an upper portion of the vertically oriented strap 22 is contacting a first layer of said horizontal strap with the horizontal strap 20 being wrapped around said first layer 20*b* of said horizontal strap 20 and an upper portion of said vertically oriented strap 22, to form an outer layer of said horizontal strap about the portable device, thereby creating an interlocking horizontal fastening system and an interlocking vertically oriented strap 22 fastening system with the interlocking horizontal fastening system and the vertically oriented interlocking system allowing for adjustability of the size of the portable device that will fit into the assembled holster. The outer surface of the completed holster 10 can be covered with a decorative covering, such as a peel and stick vinyl sheet material in various colors or patterns, including, for example, advertising or promotional material to provide a smooth, attractive appearance. The covering may be easily removed and replaced with a new covering, which will be clean and which may have different designs.

Referring to FIGS. 6, 7, there is shown an alternative embodiment of the holster 10, in which the single horizontally disposed strap 20 is replaced by two horizontally disposed straps, while the vertically disposed strap 22 remains as described above in the discussion of keyway 34 and the stop member 46 on the strap 22. The two horizontal straps are each mounted identically to the mounting system described above in connection with the vertically disposed strap 22. A right horizontally disposed strap 60, or first strap 60, is mounted in a first keyway, i.e., the right side keyway 62 and a left horizontally disposed strap 64, or second strap 64, is mounted in a second keyway, i.e., a left side keyway 66. The keyways 62, 66 are identical to the keyway 34. Different reference numerals are used for the keyways 62, 66 only to clarify their positions. The narrow strip 28 allows the user to wrap the outer end 68 of the right horizontally disposed strap 60 around the front face 15 of the base 12 and tuck it out of sight on the narrow strip 28 and also strengthening the bonds holding the straps 22, 60, 64 together. There is no horizontally disposed slot through the base 12 in this embodiment, but such a slot could be included, permitting the user to choose whether to use the two-strap embodiment of FIG. 1 or the three strap embodiment of FIGS. 6-7.

In use, the user places the portable device 54 against the front face 15 of the base 12 and brings the side of the portable device 54 against the flange 37 and pulls either of the two horizontally disposed straps 60, 66, but preferably the left horizontally disposed strap 64 firmly against the portable device 54, then pulling the vertically disposed strap 22 up and over the previously manipulated horizontally disposed strap and then pulling the other horizontally disposed strap firmly over the portable device 54 and pressing on the three straps, securing the three straps into the completed holster shown in FIG. 7. Regardless of the order in which the two horizontal straps are installed over the portable device 54, they are each pulled over the portable device 54 after it has been place against the front face 15 of the base 12. The general movements of the horizontal straps 60, 64 are as shown by the arrows 68, 70, with the arrow 68 showing the direction of movement of the right horizontally disposed strap 60 and the arrow 70 showing the general movement of the left horizontally disposed strap 64 during customizing of the holster 10. As shown in FIG. 7, this creates the same fastening system of interlocking webbing as described above in connection with FIG. 5, but in this case, with a horizontally disposed outer layer of webbing 64 and an inner layer 60 of the webbing material. These layers can be reversed by user selection during assembly. In any event the interlocking fastening system is exactly the same in FIG. 7 as it is in FIG. 5. Any excess length of any of the three straps can be trimmed to the desired length by ordinary scissors, as described above.

Figure 8:
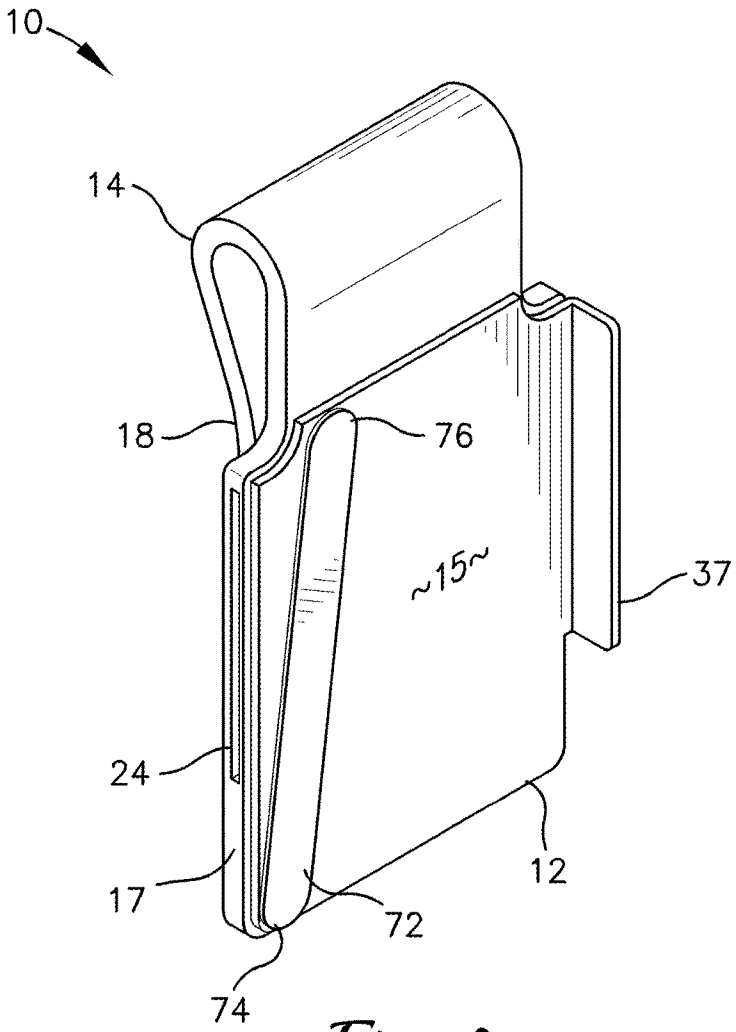
FIG. 8 is a front isometric view of the adjustable holster for portable devices as shown in FIG. 1 and FIG. 10-11 showing a spacer member.

Referring to FIG. 8, it has been found that any holster is likely to accumulate dust and debris on its front surface, such as the front surface 15 of the holster 10 and the screen of any electronic device is also likely accumulate dust and many types of dust include very hard particles with sharp edges, which will scratch nearly anything. When any electronic device with a screen is inserted into any type of holster, it is natural and conventional to place the screen against the front face because this position provides the greatest protection for the screen. When, however, the electronic device is slid into any holster and removed from it, the screen of any electronic device rubs against the face of any holster and consequently, the screen is likely to be scratched. This possibility is eliminated or minimized in the holster 10 by providing a spacer member 72 on the front face 15 of the base 12 of the holster 10, which separates all or most of the screen of the electronic device or portable device 54, from the front surface 15 of the holster 10, creating a small air gap between most or all of the surface area of the screen of an electronic device 54 and the front surface 15 of the holster 10, thereby preventing the screen of the electronic device 54 from being scratched. The separator device is provided in the present invention in the form of a spacer member 72 that is, a raised strip 72, which is on the front surface 15 of the base 12 and is an elongated strip that runs from the bottom edge 38 of the base 12 to the top edge 11 of the base 12. The spacer member 72 is a thin, narrow, elongated strip that is, about 0.47-0.63 cm (3/16-1/4 inches) wide and minimal thickness, that is, about 0.08-0.16 cm (1/32-1/16 inches) thick. The spacer member 72 is canted at an acute angle relative to the left edge 13 of the front surface 15 of the base 12, with the angle lying in range of about 60°-70° to the bottom edge 38 of the base 12, with the end 74 of the spacer member 72 being located roughly in the lower left-hand corner of the front surface 15 of the base 12 and the top end 76 of the spacer member strip 72 lying inside the perimeter of the front surface 15. The spacer member 72 is positioned such that principally the edge or frame of the screen of a cell phone or the like rides along the spacer member 72 as the electronic device is inserted into or withdrawing from the holster 10. The spacer member 72 lifts edge of the screen above the plane of the front surface 15, causing the opposing long edge or frame of the screen to ride against the front surface 15, thereby lifting the screen of an electronic device 54 off of the front surface 15, thereby preventing scratches on the screen. The spacer member strip 72 may be formed in any number of manners, such as machining, molding, attaching a separate strip by gluing, sonic welding or the like. Other structures can accomplish this purpose, such as, for example, a raised bead along the left side 17 and the right side 13 of the front surface 15 of the base 12, but the spacer member 72 as described is less likely to rub against the screen of an electronic device or portable device 54.

Figure 9:
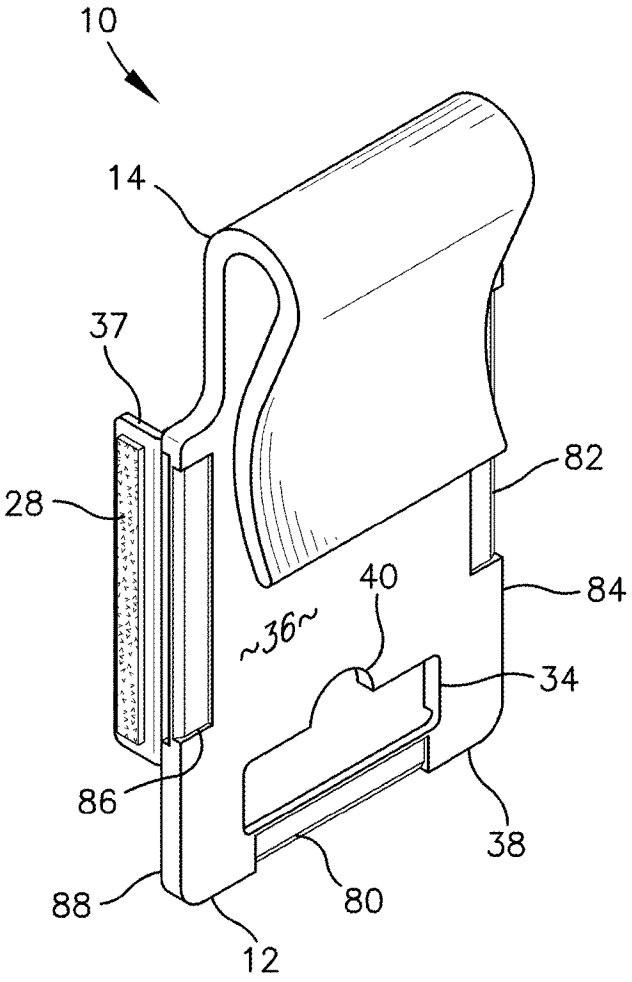
FIG. 9 is a rear isometric view of an alternative embodiment of the adjustable holster for portable devices of FIG. 1, which allows a tape to cover the straps that hold the device in the holster.
Figure 11:
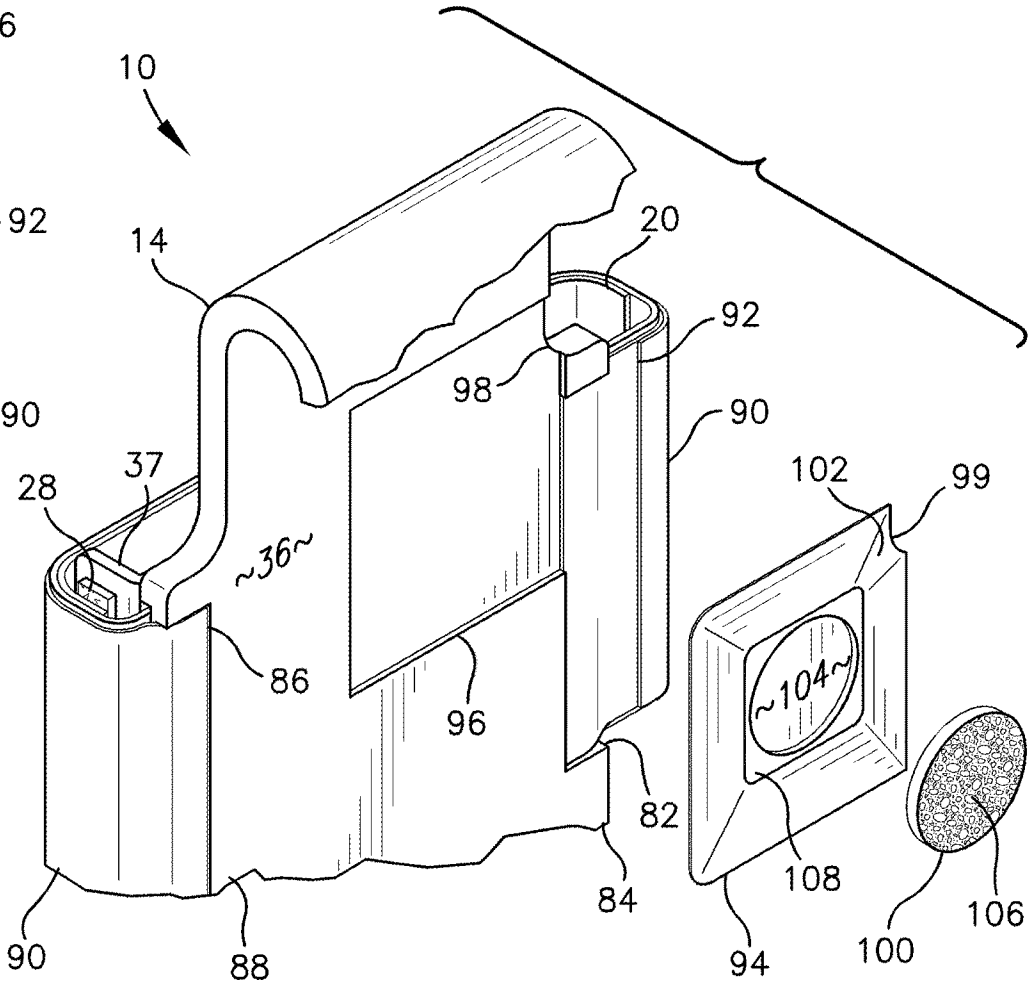
FIG. 11 is a fragmentary rear isometric view of the holster for portable devices of FIG. 9 showing a system for attaching a friction pad to a rear surface of the base.
Figure 10:
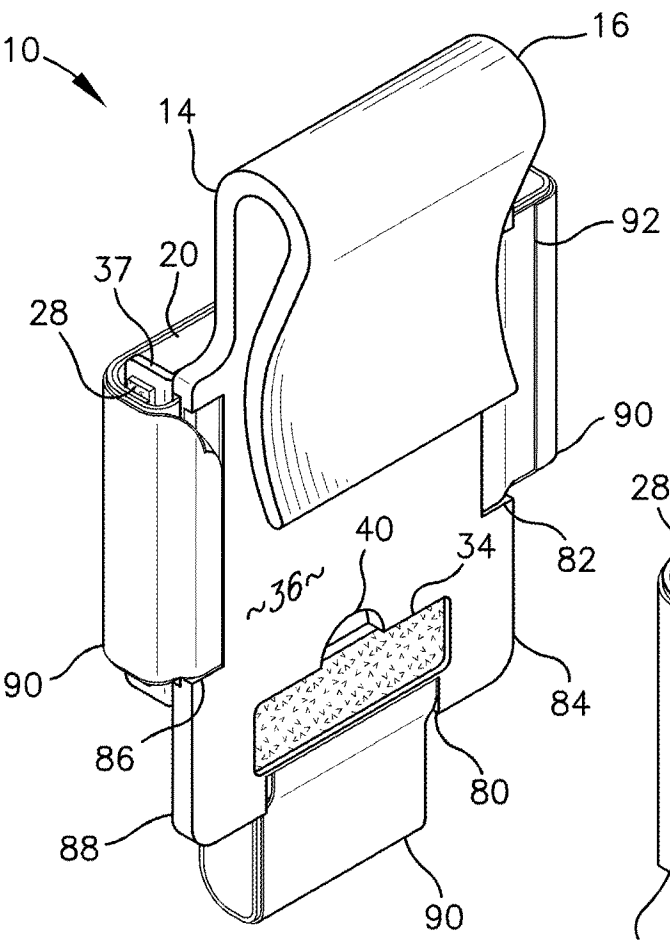
FIG. 10 is a rear isometric view of an alternative embodiment of the adjustable holster for portable devices of FIG. 1, in which tape to covers the straps that hold the device in the holster.

Referring to FIG. 9-11, it is has been found that the outer surfaces 31 of all the straps using a hook and loop fastener system may accumulate dust, small debris, lint and the like, which may be difficult or impossible to remove. To provide a smooth surface, which may include a printed advertisement, promotional logo, trademark or the like, tape is applied to each exposed outer surface 31 of the straps that use a hook and loop fastener system or other types of straps. It has, however, been found that the edges of tape may peel away from the edges of the outer surfaces 31 through wear and tear. This is prevented by providing a recessed channel along each edge of the rear surface 36 where a strap passes. The recessed channels provide a smooth recessed surface that the end of a strip of tape is attached to. The smoothness allows the tape to grip tightly and the recess of the grooves protects the tape from abrasion. Therefore, the ends of the tape are permanently attached to the recessed channels in the base 12 and to the straps that retain the device, such as a cell phone. The length of each recessed channel that is the same as the width of the strap that passes across it. The width of the smooth-faced tape that covers each strap is the same as the width of the corresponding strap.

Referring to FIG. 9, a bottom recessed channel 80 is formed into the bottom edge 38 of the rear surface 36. A right side recessed channel 82 is formed into the right side 84 of the rear surface 36 (as the holster 10 is viewed from the rear) and a left side recessed channel 86 is formed along the left edge 88 (as the holster 10 is viewed from the rear). Further, the hook fastener portion 14 in the embodiment of shown in FIGS. 9-11 has been moved inwardly of the left side edge 17 of FIG. 1 in order to provide better access to the left recessed channel 86, resulting in a hook fastener portion 14 that is roughly centered along the top edge 11 of the base 12.

Referring to FIG. 10, the adhesive tape 90, which has adhesive on one side only, that is, its backing, while its front face, that is, its exposed face, is plain and smooth and without adhesive, is shown applied over each strap 20, 22 or 60, 64. The adhesive tape 90 is preferably the same for each strap 20, 22 or 60, 64 but each separate piece of the adhesive tape 90 may be a different tape, width, color, type and the like if desired. The adhesive tape 90 may be any desired color and is preferably has a smooth outer surface. The adhesive tape 90 is applied to the holster 10 after the holster 10 has been adjusted to hold the desired portable device 54 as described above. To apply the adhesive tape 90, first, the vertically oriented strap 22 is covered by a first strip of the adhesive tape 90 by attaching an end of a length of the adhesive tape 90 to the bottom recessed channel 80 and drawing the adhesive tape 90 up over the vertically oriented strap 22 and is cut so that the top end of the vertically oriented strap 22 and the top end of the adhesive tape 90 are aligned. Then one end of a second length of the adhesive tape 90 that is fastened into either the left or right recessed channel 82, 86 and wrapped around the horizontally disposed strap 20 or horizontally disposed straps 60, 64, with the distal end of the second length of the adhesive tape 90 being cut off at any desired point beyond the outward bump that allows the holster 10 to receive the portable device 54, leaving the opposing recessed channel fully exposed. Then a proximal end of a third length of the adhesive tape 90 is fastened to the exposed recessed channel 82 or 86, as the case may be, is smoothed over and adhered to the underlying strap and is cut along line that results in the distal end of the second strip of the adhesive tape 90 lying on the rear surface 36 of the base 12 out of the way of normal wear and tear, such as along the tape line 92. Placing the an end of the relevant lengths of adhesive tape 90 into one of the recessed channels 80, 82 or 86 means that each exposed end of the adhesive tape 90 is recessed from the rear surface 36 of the base 12 and is therefore less subject to wear, except for one end of the third strip of adhesive tape 90, which is effectively remote from excessive wear due to its location on the holster 10.

Referring to FIG. 11, an enhanced friction grip system for helping retain the holster 10 on a pant's top, belt or the like is shown. This system can be employed on any embodiment of the holster 10. A friction pad holder 94 has a square face, that is, front view, and is a four-sided truncated pyramid with unequal length sides and slopes. That is, there is a difference between the top portion and bottom portion of the friction pad holder 94. A friction pad holder receiving well 96 is recessed into the upper right portion of the rear surface 36 of the base 12 and has a perimeter that matches the perimeter of the friction pad holder 94. The friction pad holder 94 can removably snapped into the mating receiving well 96 or it can be permanently glued into the receiving well 96. A cut out radius 98 in the base 12 at the upper right-hand corner of the rear surface 36 of the base 12 is identical to a cut out 99 in the upper right-hand corner of the friction pad holder 94, which serves as a locator and alignment device to insure that the two parts are properly aligned at insertion, which locates a friction pad 100 adjacent to the point where the gap between the rear surface 36 and the hook fastener portion 14 is the smallest. A tapered groove 102 provides a recess for the user's thumb to fit into while pushing the friction pad holder 94 into position for seating in the receiving well 96, which is necessarily obscured and covered by the flange portion 18 of the hook fastener portion 14. The tapered groove 102 makes moving the friction pad holder 94 into position easier.

Still referring to FIG. 11, a friction pad receiving well 104 in the friction pad holder 94 receives a friction pad 100, which both have the same perimeter and as shown are both circular, although they may be shaped differently so long as the shape and size of their perimeters are the same. The friction pad 100 is made of rubber or the like and has bumpy rough outer surface 106, which is otherwise smooth. The friction pad 100 is permanently glued into the friction pad receiving well 104 and a suitable portion of the friction pad 100 protrudes above the plane of the truncated flat upper surface 108 of the friction pad holder 94.

Figure 12:
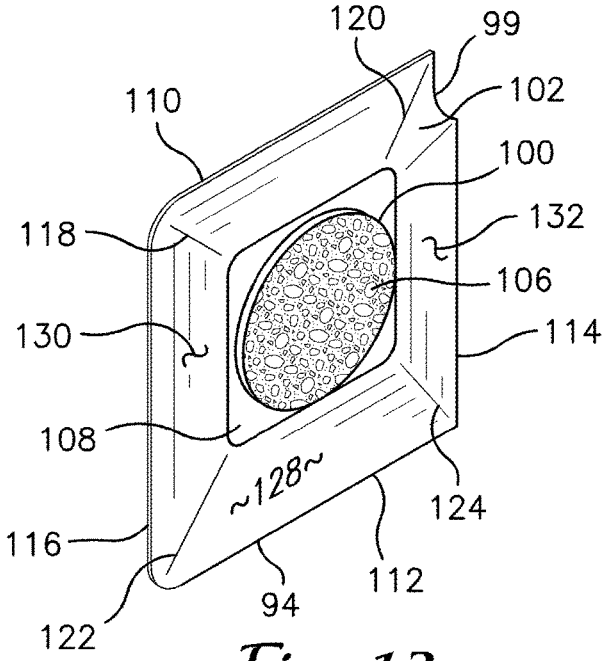
FIG. 12 is an isometric view of a friction pad holder and friction pad for use with the holster of portable devices of FIG. 11.
Figure 13:
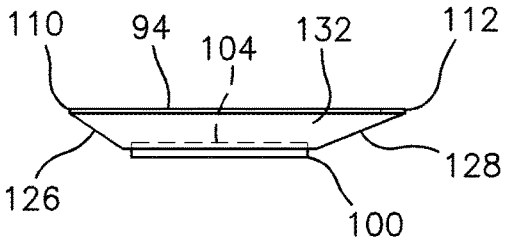
FIG. 13 is a side view of the friction pad holder and friction pad of FIG. 12.

Referring to FIGS. 12, 13, the friction pad holder 94 has a top side 110, a bottom side 112, a right side 114 and a left side 116, each being straight lines arranged to form a square (except for the cut out radius 99) with rising pyramid edge lines 118, 120, which are associated with the upper portion of the friction pad holder 94 and rising pyramid edge lines 122, 124, associated with the lower portion of the friction pad holder 94. The rising pyramid edge lines 118, 120 and the top side 110 define an upper slope face 126, while the rising pyramid edge lines 122, 124 and the bottom side 112 define a lower slope face 128. The upper slope face 126 has a steeper angle and a shorter run than the lower slope face 128, but both have the same rise. The steeper slope of the upper slope face 126 provides an additional bump or resistance to the insertion of a portable device into the holster, that is, it is an indexing mechanism that confirms to the user that the portable device is being actually seated securely into the holster 10. The rising pyramid edge lines 118 and 122 define a sloped left side face 130 and the rising pyramid edge lines 120 and 124 define a sloped left side face 132. The sloped left side face 130 and the sloped right side face 132 have the same slope and the same run and rise.

Figure 14:
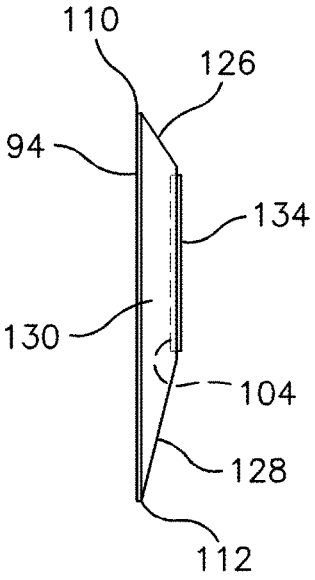
FIG. 14 is a side view of the friction pad holder and friction pad of FIG. 12 showing a low-friction pad installed into the friction pad holder.
Figure 15:
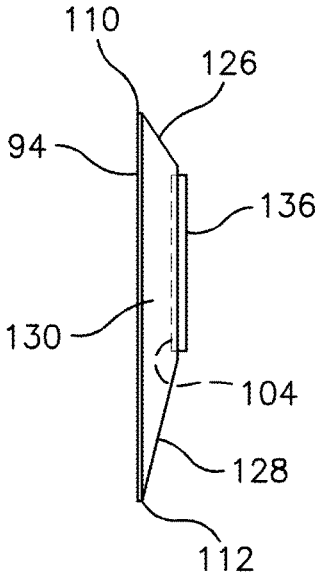
FIG. 15 is a side view of the friction pad holder and friction pad of FIG. 12 showing a medium-friction pad installed into the friction pad holder.
Figure 16:
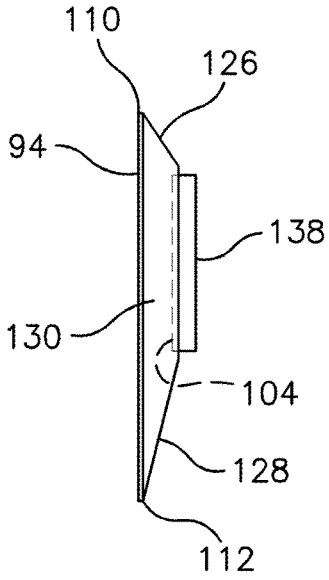
FIG. 16 is a side view of the friction pad holder and friction pad of FIG. 12 showing a high-friction pad installed into the friction pad holder.

Referring to FIGS. 14-16, the friction pad 100 is provided in three different thicknesses, with the outer surface 106 of the friction pad 100 protruding from the truncated flat upper surface 108 of the friction pad holder 94 by the least amount in the embodiment of FIG. 14, by a medium amount in the embodiment of FIG. 15 and by a maximum amount in the embodiment shown in FIG. 15. Three separate fiction pad holders 94 are provided, each with friction pad 100 of different thicknesses. The user can select the friction pad holder 94 that best meets his needs and snap it into the friction pad well 96. If the particular friction pad holder 94 and friction pad 100 combination prove unsuitable, the user can remove one and insert another. The thicker the friction pad 100 is, the greater the friction and corresponding resistance to inserting or removing the portable device 54 from the holster 10. Referring to FIG. 14, the thinnest friction pad 134 is intended to be suitable for a user wears the holster 10 in a calm environment with little likelihood of incidents that might jostle the portable device 54 free from the holster 10, such as an office setting. Referring to FIG. 15, a medium thickness friction pad 136 is intended for a user working in an environment, for example, trucking or construction, where the portable device 54 may be subjected to greater jostling. As shown in FIG. 16, the thickest friction pad 138 is intended for user working in the most physically vigorous environments, such as logging. Alternatively, the user may be provided with friction pads 100 of varying thickness and materials and on friction pad holder 94 and choose a suitable friction pad to install in the friction pad holder 94. In this case, the appropriate friction pad 134, 136 or 138 can be retained in the friction pad well 96 by friction, which makes the friction pads 134, 136, 138 or other size, interchangeable at will, or may be glued in place by the user. By using this system, a user can select the friction pad 134, 136, 138 or other size that is suitable for his use of the holster 10. In any case, the friction pad holder 94 and installed friction pad 100 combined, present a minimal leading edge to the portable device 54 as it is being inserted into or withdrawn from the holster 10 and the edges, i.e., circumference, of the friction pad 100 or the like is securely seated into the friction pad receiving well 104, preventing the friction pad 100 or the like from peeling away from the holster 10 in normal use, thereby overcoming the problem with tape or the like that may be attached to the rear surface 36 of the holster 10. Alternatively, friction ridges or patterns may be cut or formed into the rear surface 36 of the base 12 or to the inner surface of the hook portion 14 or both. In every case, the depth of the friction pad receiving well 104 of the same and the friction pad has a rough outer surface 106.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A holster for a portable device comprising:

a. a base having a front surface and a rear surface, and a perimeter having a top edge and a bottom edge, a left side edge and a right side edge; and b. at least one horizontally disposed strap wrapped around at least a portion of said front surface of said base;

c. a vertically oriented strap wrapped around said bottom edge and said front surface of said base, wherein said horizontally disposed strap and said vertically disposed strap each further comprise one surface covered with hook elements of a hook and loop fastener system and said horizontally disposed strap and said vertically disposed strap each further comprise an opposing surface covered with loop elements of a hook and loop fastener system;

d. an adhesive tape covering outer surfaces of said at least one horizontally disposed strap and said vertically oriented strap, whereby said hook elements of said at least one horizontally disposed strap and said hook elements of said vertically disposed strap are prevented from accumulating debris; and e. a recessed channel along said left side edge of said base and a recessed channel formed along said right side edge of said base and a recessed channel along a bottom edge of said rear surface, whereby each exposed end of said adhesive tape in a recessed channel is recessed from the rear surface of said base and is therefore less subject to wear.

2. A holster in accordance with claim 1 further comprising a horizontally disposed slot through said base with said at least one horizontally disposed strap being threaded through said horizontally disposed slot.

3. A holster in accordance with claim 1 further comprising a keyway in a lower portion of said base recessed into said rear surface of said base and a keyway slot running from said keyway to said bottom edge of said base, said base having a thickness and said keyway slot being formed in said thickness.

4. A holster in accordance with claim 1 further comprising a flange formed on at least one of said right side edge and said left side edge of said base and projecting forward of said front surface of said base.

5. A holster in accordance with claim 4 further comprising a strip of hook or loop material fixed to an outer edge of said flange for attaching an end of said horizontal strap.

6. A holster in accordance with claim 1 further comprising a spacer member on said front surface of said base, whereby said spacer member creates a space between said front surface of said base and all or most of a screen of an electronic device, thereby preventing the screen of the electronic device from being scratched by rubbing against said front surface.

7. A holster in accordance with claim 1 further comprising a first keyway adjacent to said right edge of said base and a second keyway adjacent to said left edge of said base and a left keyway slot running from said left keyway to said left edge of said base and a right keyway slot running from said right keyway slot to said right edge of said base.

8. A holster in accordance with claim 7 further comprising a first horizontally oriented strap inserted into said right keyway and a second horizontally disposed strap inserted into said left keyway and a stop on an end of each said first and second straps where said first and second straps are inserted into the respective said right and left keyways.

9. A holster in accordance with claim 8 further comprising a keyway in a lower portion of said base recessed into said rear surface of said base and a vertically oriented slot through a thickness of said base running from a lower edge of said keyway to a bottom edge of said base the vertically oriented strap threaded through said vertically oriented slot and a stop member on an end of said vertically oriented strap to prevent said strap from being pulled entirely through said vertically oriented slot and said vertically oriented strap being wrapped around said bottom edge and said front surface of said base and upward over a portion of a portable device to be held in said holster.

10. A holster in accordance with claim 1 further comprising a spacer member along said front surface, said spacer member having a bottom end lying adjacent to an edge of said front surface and canted to an acute angle to said edge whereby said spacer member creates a space between said front surface of said base and all or most of a screen of an electronic device, thereby preventing the screen of the electronic device from being scratched by rubbing against said front surface.

11. A holster in accordance with claim 1 further comprising a friction pad holder seated in a friction pad holder well formed on said rear surface of said base and a friction pad seated in a friction pad receiving well in said friction pad holder.

12. A holster for a portable device comprising:

a. a base having a front surface and a rear surface, and a perimeter having a top edge and a bottom edge, a left side edge and a right side edge; and b. at least one horizontally disposed strap wrapped around at least a portion of said front surface of said base, said at least one horizontally disposed strap having an outer surface covered with hook elements of a hook and loop fastener system and an inner surface covered with loop elements of a hook and loop fastener system;

c. a keyway in a lower portion of said base recessed into said rear surface of said base, said keyway further comprising an elongated channel having two parallel side walls formed in said base with said channel lying parallel to said bottom edge of said base, said channel having a depth equal to the thickness of a vertically oriented strap and a keyway slot formed in the thickness of said base and running from said keyway to said bottom edge of said base, said base having a thickness and said keyway slot being formed in said thickness; and d. a vertically oriented strap having an outer surface covered with hook elements of a hook and loop fastener system and an inner surface covered with the loop elements of a hook and loop fastener system, said vertically oriented strap having a width equal to a length of said channel and being threaded through said vertically oriented slot and a stop member having a width equal to the length of said channel and a depth equal to said depth of said channel, said stop member being fixed to an end of said vertically oriented strap to prevent said strap from being pulled entirely through said vertically oriented slot and said vertically oriented strap being wrapped around said bottom edge and said front surface of said base, contacting an inner first layer of said horizontal strap with said horizontal strap being wrapped around said inner layer of said horizontal strap and an upper portion of said vertically oriented strap to form an outer layer of said horizontal strap about the portable device, thereby creating an interlocking horizontal fastening system and an interlocking vertically oriented strap fastening system with said interlocking horizontal fastening system and said vertically oriented interlocking system allowing for adjustability of the size of the portable device that will fit into the assembled holster.

13. A holster for a portable device comprising:

a. a base having a front surface and a rear surface, and a perimeter having a top edge and a bottom edge, a left side edge and a right side edge;

b. at least one horizontally disposed strap wrapped around at least a portion of said front surface of said base;

c. a first keyway adjacent to said right edge of said base and a second keyway adjacent to said left edge of said base and a left keyway slot running from said left keyway to said left edge of said base and a right keyway slot running from said right keyway slot to said right edge of said base;

d. a first horizontally oriented strap inserted into said right keyway and a second horizontally disposed strap inserted into said left keyway and a stop on an end of each said first and second straps where said first and second straps are inserted into the respective said right and left keyways;

e. wherein said at least one horizontally disposed strap and said vertically oriented strap each have an outer surface covered with hook elements of a hook and loop fastener system and an inner surface covered with loop elements of a hook and loop fastener system; and f. a friction pad holder seated in a friction pad holder well formed on said rear surface of said base and a friction pad seated in a friction pad receiving well in said friction pad holder.

14. A holster in accordance with claim 13 wherein said friction pad holder further comprises a truncated pyramid having an upper slope surface that is shorter and at a steeper upward angle than a lower slope surface.

15. A holster in accordance with claim 13 further comprising a plurality of friction pads of different thicknesses whereby a user can select the friction pad suitable for his use.

16. A holster in accordance with claim 15 further comprising a hook portion at the top of said base having a depending member and a spring portion for attaching the holster to another object.

17. A holster for a portable device comprising:

a. a base having a front face and a rear face, and perimeter having a top edge and a bottom edge, a left side edge and a right side edge; and b. at least one horizontally disposed strap wrapped around at least a portion of said front face of said base, said at least one horizontally disposed strap having an outer surface covered with hook elements of a hook and loop fastener system and an inner surface covered with loop elements of a hook and loop fastener system;

c. a horizontally disposed slot through a thickness of said base for receiving said horizontally disposed strap;

d. a keyway in a lower portion of said base recessed into said rear face of said base and a keyway slot running from said keyway to said bottom edge of said base, said base having a thickness and said keyway slot being formed in said thickness; and e. a vertically oriented strap having an outer surface covered with hook elements of a hook and loop fastener system and an inner surface covered with loop elements of a hook and loop fastener system, said vertically oriented strap being threaded through a vertically oriented slot and a stop member on said vertically oriented strap to prevent said strap from being pulled entirely through said vertically oriented slot and said vertically oriented strap being wrapped around said bottom edge and said front face of said base; and f. a flange formed on at least one of said right side edge and said left side edge of said base and projecting forward of said front face of said base.

* * * * *